US005868510A

United States Patent [19]

Lacout et al.

[11] Patent Number: 5,868,510

[45] Date of Patent: Feb. 9, 1999

[54] PRODUCT DISPENSER HAVING A ROTARY DRIVE MEMBER, AND A METHOD OF MANUFACTURE

[75] Inventors: Franck Lacout, Athis-Mons; Vincent de Laforcade, Rambouillet, both of France

[73] Assignee: L'Oreal, Paris, France

[21] Appl. No.: 874,474

[22] Filed: Jun. 16, 1997

[30] Foreign Application Priority Data

Jun. 19, 1996 [FR] France ..... 96 07613

[51] Int. Cl.[6] ..... A45D 40/06

[52] U.S. Cl. ..... 401/70; 401/75; 401/79; 401/175

[58] Field of Search ..... 401/68, 70, 75, 401/79, 175; 222/390

[56] References Cited

U.S. PATENT DOCUMENTS

| | | | |
|---|---|---|---|
| 2,917,765 | 12/1959 | Jakubowski | 401/175 |
| 2,935,191 | 5/1960 | Leshin | 401/175 X |
| 3,333,689 | 8/1967 | Terrill et al. . | |
| 3,612,705 | 10/1971 | Duval | 401/75 |
| 4,865,480 | 9/1989 | Reynolds et al. | 401/175 |
| 5,255,990 | 10/1993 | Dornbusch et al. | 401/70 X |

FOREIGN PATENT DOCUMENTS 2438986 5/1980 France .

*Primary Examiner*—David J. Walczak
*Assistant Examiner*—Kathleen J. Prunner
*Attorney, Agent, or Firm*—Oliff & Berridge, PLC

[57] ABSTRACT

A product dispenser includes a receptacle having a cylindrical body that is open at one of its ends, a piston that is axially movable in translation in the body, and a drive screw passing through an orifice in the piston. The orifice is provided with a link suitable for transforming rotary motion of the screw into axial displacement of the piston. The screw is rotated by a drive member accessible to the user, and the link is radially deformable. The link is organized to deform radially in contact with the thread of the screw when the screw is forced to move axially relative to the link, thereby allowing relative axial movement between the screw and the link even if the screw is not rotated.

19 Claims, 3 Drawing Sheets

PRODUCT DISPENSER HAVING A ROTARY DRIVE MEMBER, AND A METHOD OF MANUFACTURE

The present invention relates to a product dispenser having a rotary drive member, in particular for dispensing a cosmetic.

BACKGROUND OF THE INVENTION

It is already known that such dispensers can be used for packaging and applying deodorants in stick form, i.e. in the form of a solid cake.

Such dispensers comprise a receptacle having a cylindrical body that is open at one of its ends, a piston that is axially movable in translation inside the body, and a drive screw mounted to rotate inside the receptacle and passing through a tapped orifice in the piston.

The stick is associated with the piston and by turning the drive member in the appropriate direction, the piston is caused, under drive from rotation of the drive screw, to move towards the open end of the cylindrical body so as to extend the stick and enable the product to be removed by rubbing. By turning the drive member in the opposite direction, the piston is moved in the opposite direction to retract the stick of product and to enable a closure cap to be put into place on the receptacle.

When assembling the dispenser, in order to mount the piston inside the cylindrical body of the receptacle, a first solution consists in initially mounting the drive screw inside the receptacle, and in subsequently engaging the tapped orifice of the piston on the free end of the screw. The piston is then moved into the receptacle by turning the drive member. That solution can be difficult to implement when the drive member is constituted by a knurled knob which is accessible only through windows formed in the base of the receptacle since that reduces the available contact area and increases the number of handling operations that need to be performed to rotate the knob.

Another solution has thus been proposed which consists in making the central portion of the piston removable by means of a snap-fastening and by ensuring that the transverse size of the central portion is small enough to enable it to be inserted at the end of a rotary tool via the open end of the cylindrical body and then displaced along the drive screw by rotating the tool until a predetermined position is reached inside the receptacle. Thereafter, it suffices to cause the remaining portion of the piston to slide from the open end of the cylindrical body until it snap-fastens onto the central portion of the piston which is already in place inside the receptacle. With that solution, there is thus no longer any need to rotate the drive member in order to position the piston inside the receptacle.

OBJECTS AND SUMMARY OF THE INVENTION

An object of the present invention is to further improve a dispenser of the type comprising a receptacle having a cylindrical body open at one of its ends, a piston axially movable in translation in said body, and a drive screw passing through an orifice in the piston, which orifice is provided with link means suitable for transforming rotary motion of the screw into axial displacement of the piston, said screw being capable of being rotated by a drive member accessible to the user.

A particular object of the invention is to make manufacture of the dispenser even easier.

The invention achieves this by the fact that said link means being radially deformable, they are organized to deform radially in contact with the thread of the screw when the screw is forced to move axially relative to the link means, thereby allowing the screw to escape.

Thus, assembly of the dispenser is facilitated since the piston can be pushed into the receptacle without any need to rotate the drive member and without any need to make the piston with a removable central portion.

The link means are preferably elastically deformable and advantageously comprise at least two sectors having a threaded inside cylindrical surface and connected to the remainder of the piston in such a manner as to enable them to move apart from one another.

It can also happen that the user attempts to turn the drive member in the wrong direction on the first occasion that the dispenser is used.

When the drive member is constituted by a knob of circular section, the torque exerted by the user on the screw remains fairly low, and since the piston is in low position abutment it merely prevents the knob from being rotated in the wrong direction. However, since the present trend is towards using drive members that have a cross-section of elongate shape in order to enable higher torque to be transmitted to the screw so that the piston can be moved axially through a greater distance on each revolution of the drive member, the user is being given the opportunity of exerting sufficient torque to break the screw when the drive member is jammed by the piston being in abutment in its low position.

The invention makes it possible to use a drive member of elongate cross-section without any risk of the screw being damaged when the drive member is turned in the wrong direction.

When jammed by the piston being in abutment in its low position, turning the drive member in the wrong direction merely causes the screw to escape from the inside of the link means without running the risk of damaging the dispenser.

In a particular embodiment of the invention, the above-mentioned sectors are urged radially inwards by an elastically deformable return member which exerts its return force at least on the free ends of the sectors.

In a particular embodiment of the invention, the return member is in the form of a ring or a sleeve of elastomer material surrounding the sectors, at least at the bottom portion thereof. In a variant, the return member may be in the form of bridges of material extending between the sectors.

These bridges of material may be integrally formed out of the same material as the sectors, or they may be made out of an elastomer material.

Advantageously, the cylindrical body includes at least one abutment for limiting the stroke of the piston when pushed into the receptacle.

Advantageously, the drive member is integrally molded with said screw. Preferably, it is integrally molded with a skirt shaped to snap-fasten in a bushing of the receptacle and capable of rotating freely therein.

Preferably, the drive screw has a pitch lying in the range 2 mm to 16 mm, and preferably in the range 4 mm to 7 mm, thus enabling a relatively large amount of piston displacement to be obtained on each revolution of the drive member.

The invention also provides a method of manufacturing a product dispenser, in particular for dispensing a cosmetic such as a stick deodorant, the dispenser comprising a receptacle having a cylindrical body open at one of its ends, a piston that is movable in translation in said body, and a screw passing through an orifice in the piston, which orifice is fitted with link means suitable for transforming rotary motion of the screw into axial displacement of the piston, said screw being capable of being rotated by a drive member accessible to the user, wherein the method comprises the steps consisting in:

mounting the screw in the receptacle;

bringing the piston to said open end of the cylindrical body; and pushing the piston into the receptacle, said link means being radially deformable so as to be capable of deforming radially to pass over the thread of the screw while the piston is being pushed in.

BRIEF DESCRIPTION OF THE DRAWINGS

Other characteristics and advantages of the present invention appear on reading the following detailed description of non-limiting embodiments of the invention, and on examining the, accompanying drawings, in which.

DETAILED DESCRIPTION OF PREFERRED EMBODIMENTS

Figure 1:
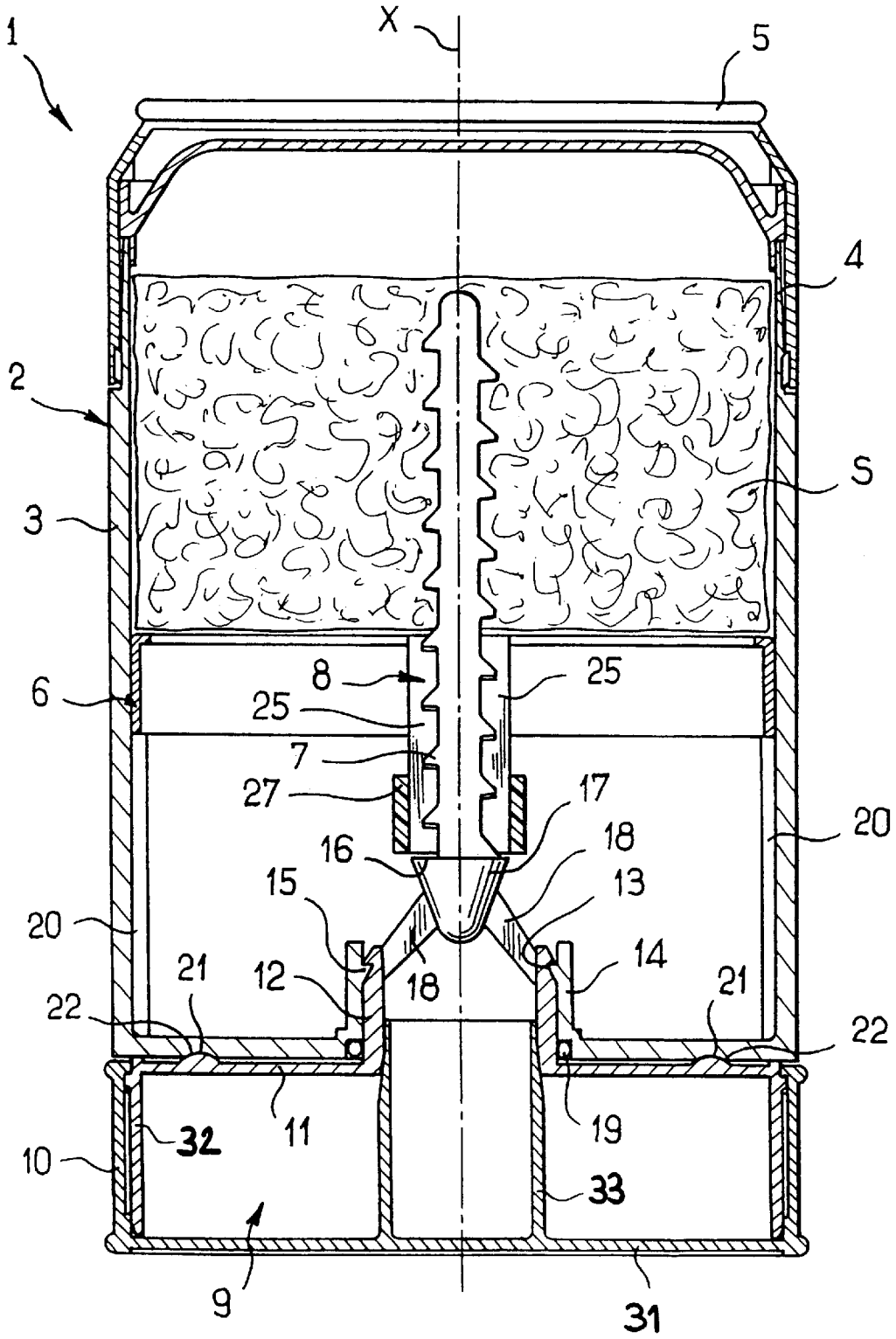
FIG. 1 is a diagrammatic axial section view of a dispenser constituting a first embodiment of the invention.

FIG. 1 shows a dispenser 1 constituting a particular embodiment of the invention.

The dispenser 1 comprises a receptacle 2 having a body 3 that is cylindrical about an axis X and with a cross-section that is oval. Naturally the invention is not limited to this particular shape of cross-section.

The cylindrical body 3 is open at its top end 4 and in the vicinity of this top opening it has reduced wall thickness to constitute a seat for a closure cap 5.

The dispenser 1 also includes a piston 6 whose right section corresponds accurately to the inside section of the cylindrical body 3, thus preventing it from rotating inside the cylindrical body 3. The piston 6 can be moved axially in translation inside the cylindrical body 3.

A drive screw 7 is mounted to rotate freely about the axis X inside the receptacle 2, while being prevented from moving axially. This screw extends over substantially the full height of the cylindrical body 3.

Link means 8 are provided to transform rotary motion of the screw 7 into translation of the piston 6 along the axis X inside the cylindrical body 3.

In the example described, the piston 6 carries a stick S, i.e. a solid cake, of body deodorant, for example. In this case, there is no need to provide sealing means to ensure that the piston 6 moves in sealed manner inside the cylindrical body 3, nor is any particular sealing required where the screw 7 passes through the link means 8. Nevertheless, matters may be different when the product is a cream or a gel. The product may then be expelled through a dome that is pierced with multiple outlet orifices and that is fitted over the top opening of the cylindrical body 3.

In the embodiment described, the piston 6 has a side wall 23 and a latticework top face 24 associated with the stick S.

The bottom end of the screw 7 is secured to a drive member 9 accessible to the user at the end of the cylindrical body 3 remote from its opening. In the example described, the drive member 9 comprises a transverse wall 11 integrally molded out of the same plastics material as the screw 7. An outer skirt 10 is snap-fastened on an inner skirt 32 that extends the periphery of the wall 11 downwards. The outer skirt 10 constitutes a grasping surface enabling the user to grasp the drive member and to turn it about the axis X. Because the shape of the cross-section of the outer skirt 10 is elongate, it is possible for the user to impart considerable torque to the drive member 9. In addition, the outer skirt 10 is closed by a bottom wall 31. The transverse wall 11 is extended upwards in the middle by a cylindrical skirt 12. The radially outer surface of this skirt is provided with an annular retaining groove 13 enabling it to be snap-fastened in a bushing 14 extending into the inside of the receptacle and formed at the bottom thereof. The radially inside surface of the bushing 14 is provided with an annular rib 15 designed to be received in the retaining groove 13 when the skirt 12 is fully inserted.

Figure 2:
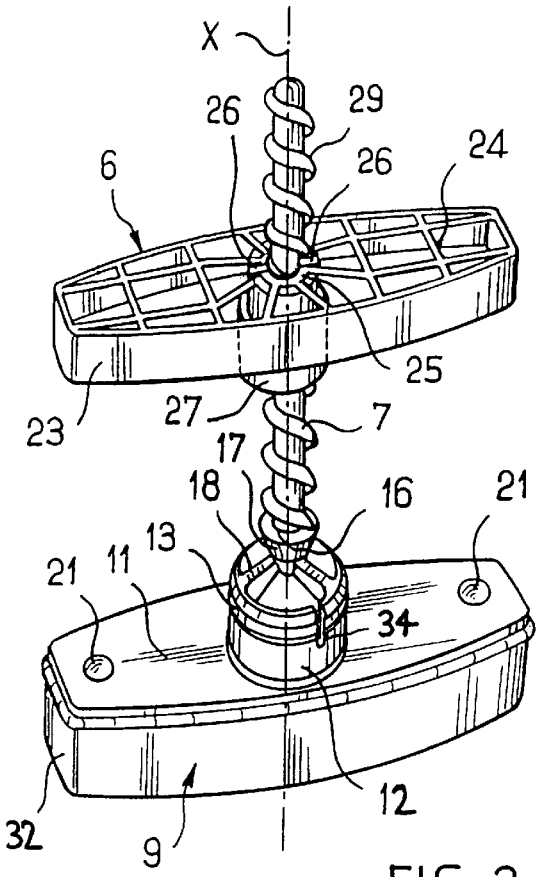
FIG. 2 is a diagrammatic perspective view showing the drive screw, the drive member, and the piston.

As can be seen in FIG. 2, the skirt 12 advantageously includes at least one axial slot 34 designed to facilitate resilient passage of the annular rib 15 over the free end of the skirt 12 when the drive member 9 is assembled with the receptacle 2.

The inside of the bottom 31 is provided with an annular sealing lip 33 which fits inside the skirt 12 so as to provide a sealed closure of the receptacle 2 once it has been filled, in the manner described below.

The bottom end of the screw 7 connects with the base 16 of a cone 17 that converges down towards the skirt 12 and that is fixed thereto by three sloping link tabs 18 uniformly distributed around the axis X.

An O-ring 19 is received against a shoulder formed in the base of the bushing 14 to be interposed between the bushing and the skirt 12 so as to prevent air entering the receptacle 2 through its bottom and causing the product contained therein to deteriorate.

Projections 21 may be formed on the top face of the transverse wall 11 to engage in appropriately shaped recesses 22 formed in the bottom face of the receptacle 2 so as to create a click point in rotation of the drive member 9 making it easy for a user to position it so that it extends the cylindrical body 3 of the receptacle.

Advantageously, and as shown in FIG. 1, the receptacle 2 is provided on the inside with ribs 20 to limit the downward stroke of the piston 6. It will be observed that when the piston 6 is resting with its side wall 23 in bottom abutment on the top ends of the ribs 20, the bottom end of the link means 8 is situated slightly above the base 16 of the cone 17.

Figure 3:
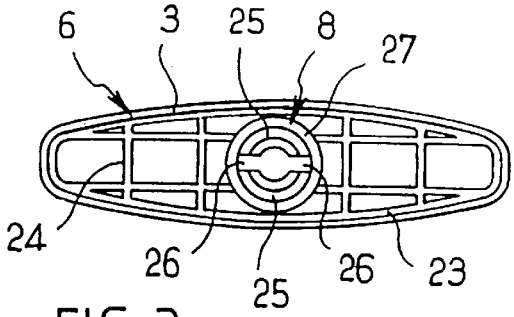
FIG. 3 is a view from beneath of the piston shown in FIG. 2.

The link means 8 are described below with reference more particularly to FIGS. 2 and 3.

In the embodiment described, the link means 8 comprise two sectors 25 separated by diametrically opposite slots 26, and a ring 27 of elastomer material surrounding the bottom portions of the sectors 25.

The top ends of the sectors 25 are connected to fillets of the material from which the top wall 24 of the piston 6 is made and they are made by being integrally molded therewith. The sectors 25 are threaded on their radially inside faces so as to be capable of engaging on the thread of the screw 7, thereby transforming rotary motion thereof into axial displacement of the piston 6, like a screw jack. Reference 28 designates the hollow threads formed in the sectors 25. The projecting thread on the screw 7 is given reference 29.

In accordance with the invention, the sectors 25 can spread apart so as to move past the thread of the screw 7 when the piston is not free to move inside the cylindrical body 3 because it is in abutment against the ribs 20, or when thrust is exerted on the piston to move it downwards.

Figure 4:
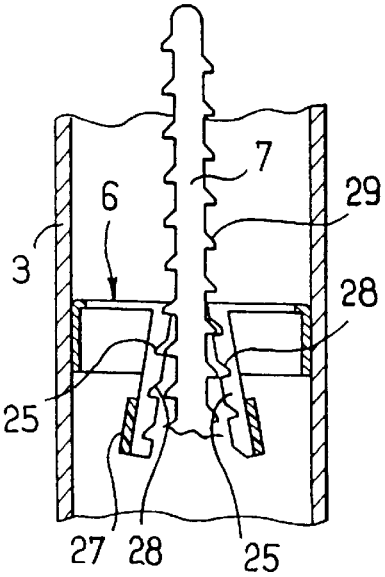
FIGS. 4 to 6 show how the link means deform to allow the screw to escape.
Figure 6:
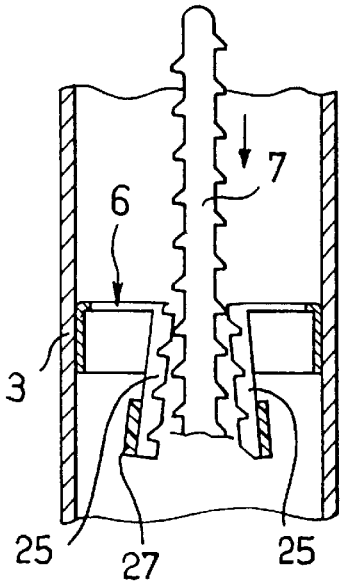
Figure 5:
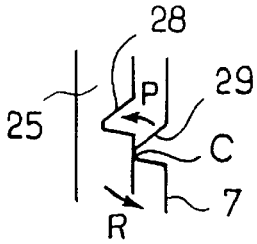

FIGS. 4 to 6 show how the sectors 25 deform progressively to allow the screw to escape.

When an attempt is made to force relative axial displacement between the screw 7 and the sectors 25, the sectors tend to spread apart away from each other, as shown in FIG. 4.

The sectors 25 are connected to the top wall 24 via their top ends only, so each of them tends to pivot about an axis of rotation which is perpendicular to the axis X and parallel to the plane containing the slots 26. When the sectors 25 move apart, they stretch the ring 27 that was initially at rest, thereby causing a return force to be exerted that increases with increasing distance beyond the bottom ends of the sectors 25.

Arrow R in FIG. 5 represents the return force exerted by the ring 27 on a sector 25. After the thread 29 has disengaged from a hollow thread 28, the thread 29 tends to rest against the surface of the sector 25 adjacent to the bottom of the hollow thread 28 because of the return force exerted by the ring 27. This generates a tilting torque P exerted by the ring 27 on the sector 25 about the line of contact C of the thread 29 against the sector 25, with tilting being in a direction that tends to cause the top portion of the sector 25 to move away from the diametrically opposite sector 25. This serves firstly to prevent the bottom portions of the sectors 25 moving apart excessively since that would run the risk of breaking the link between the sectors 25 and the top wall 24 of the piston, and secondly this facilitates disengagement of the threads 28 in the top portions of the sectors 25, as shown in FIG. 6.

It will be observed that when the piston is in bottom abutment on the ribs 20 and the screw 7 is rotated in the direction that tends to move the piston downwards, the ribs 20 keep the top end 4 of the piston perpendicular to the axis X, thereby making it easier for the screw 7 to escape.

Naturally, the invention is not limited to the embodiment of the link means 8 as described above.

Figure 7:
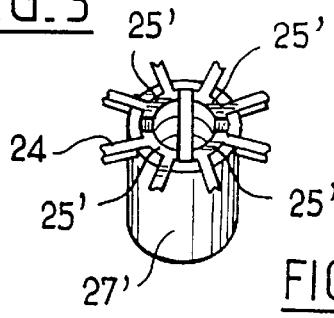
FIGS. 7 and 8 show various embodiments of the link means.
Figure 9:
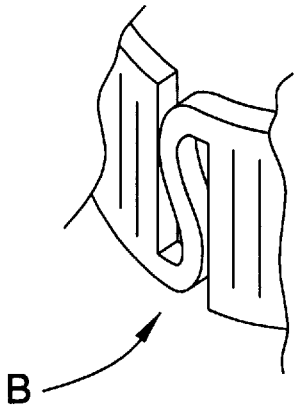
FIG. 9 shows an integrally formed S-shaped bridge of material according to the present invention.

Thus, it is possible to make link means that enable the screw to escape in a different manner. In particular, more than two sectors could be provided, e.g. four sectors 25' angularly distributed uniformly around the axis X, as shown diagrammatically in perspective in FIG. 7. The resilient return means may also be made differently. Thus, the ring of elastomer material that surrounds the bottom portions of the sectors in the preceding embodiment is replaced in the embodiment of FIG. 7 by a sleeve 27' of elastomer material that is molded over the full height of the sector 25'. It is also possible to interconnect the sectors by means of S-shaped bridges B(FIG. 9) of material, using the same material as said sectors, and allowing the sectors to move apart while nevertheless exerting a return force thereon.

Figure 8:
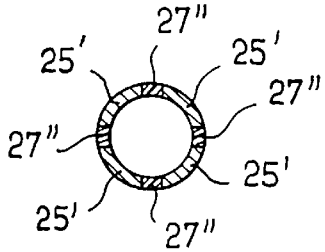

Also, as shown in the cross-section of FIG. 8, it is possible to exert the return force, not by means of a ring or a sleeve surrounding the sectors 25', but by means of bridges of material 27" extending between the sectors 25' over all or part of the height thereof, and made of elastomer material. The link means shown in FIG. 8 may advantageously be made by dual injection, i.e. by injection molding the cylindrical sectors 25' and the top wall 24 of the piston out of a relatively rigid first plastics material while injection molding the bridges of material 27" out of an elastomer which is bonded to the first plastics material by local melting. Suitable pairs of materials include: polyolefin and ethylene-propylene diene monomer (EPDM); polystyrene and styrene-ethylene-butadiene-styrene (SEBS).

In an embodiment not shown, it is also possible to make said sectors out of elastomer material.

To assemble the dispenser 1, the first step is to fix the drive member 9 by inserting the screw 7 and then the skirt 12 into the bushing 14 until the annular rib 15 snaps into place. The drive member 9 is positioned so that the internal skirt 32 lies substantially in register with the cylindrical body 3 of the receptacle 2.

Thereafter, the piston 6 is brought to the opening in the cylindrical body and then moved down the screw 7 by applying axial thrust parallel to the axis X. As the piston 6 is moved down, which can be done with the help of an actuator, the screw 7 escapes from the link means 8. When the piston reaches the desired position inside the receptacle, which position advantageously corresponds to the sidewall 23 coming into abutment against the ribs 20, the threads 28 are normally engaged on the thread 29 of the screw 7, and the ring 27 is no longer stressed when the piston and the drive member are in this relative position. This ensures that it retains its elasticity in full, even if it is stored for a long time before use.

When the product S is a solid cake, it is advantageously put into place by being cast while in liquid form, the receptacle 2 then being upside-down and casting taking place,through the skirt 12. The closure cap 5 is then in place on the receptacle. The holes formed in the latticework wall 24 of the piston allow the product to fill the space available inside the receptacle 2 adjacent to the opening of the cylindrical body 3. The depth of product is selected to overlie the latticework 24 a little, thereby ensuring that the stick is secured to the piston 6 after the product has set. Thereafter, the outer skirt 10 is snapped into place on the inner skirt 32 of the drive member.

To use the product, the user removes the cover 5 and causes the product to move upwards by turning the drive member 9. The product is taken off by rubbing. While the product is being taken off, the link means exert sufficient force on the screw 7 to prevent the piston from moving back into the receptacle, with the thrust that needs to be exerted on the piston to cause the screw to escape being selected to be considerably greater than the force normally exerted on the piston when the stick is moved over the skin.

As explained above, assembling a dispenser of the invention is much easier than assembling prior art dispensers.

In addition, if the user turns the drive member in the wrong direction, with the piston 6 in bottom abutment in contact with the ribs 20, then the screw 7 escapes from the link means 8 without running the risk of breaking. As soon as the user turns the screw in the opposite direction through more than half a turn, the ring 27 returns the threads 28 into engagement on the thread 29 of the screw 7 and the piston can begin to move upwards.

Finally, when the stick S is extended, the user can return it very quickly to the inside of the receptacle merely by applying axial thrust thereon, without it being necessary to rotate the drive member 9. This return force can be exerted by placing the closure cover 5 on the receptacle and by pushing it down until it comes into abutment against its seat formed in the top portion of the receptacle 2.

The screw 7 can escape from the link means without any need for the user to act on an unlocking member.

The link means 8 deform automatically on coming into contact with the screw when the screw is forced to move in axial displacement relative to the link means.

Naturally, it would not go beyond the ambit of the invention to use a drive member in the form of a knob accessible through windows formed in the base of the receptacle.

We claim:

1. A product dispenser comprising:

a receptacle having a cylindrical body including an open end;

a piston axially movable in translation in said body; and a drive screw passing through an orifice in the piston, the orifice being provided with link means for transforming rotary motion of the drive screw into axial displacement of the piston, said drive screw having a thread and being rotatable by a finger-operated drive member, said link means being radially deformable, wherein the link means deforms radially while contacting the thread of the drive screw when the drive screw and the link means are forced to move axially relative to one another thereby allowing the piston to move axially with respect to the screw without rotation of the screw.

2. A dispenser according to claim 1, wherein said link means are elastically deformable.

3. A dispenser according to claim 1, wherein said link means comprise at least two sectors having a threaded inside cylindrical surface and connected to a remainder of the piston in such a manner as to enable them to move apart from one another.

4. A dispenser according to claim 3, wherein said sectors are elongate in shape along an axis of the screw and each of them is connected to the piston at one end.

5. A dispenser according to claim 4, wherein said sectors have free ends and are urged radially inwards by an elastomer deformable return member, and wherein said return member exerts its return force at least via the free ends of the sectors.

6. A dispenser according to claim 3, wherein said sectors are integrally molded with at least one transverse wall of the piston.

7. A dispenser according to claim 3, wherein said sectors are urged radially inwards by an elastomer deformable return member.

8. A dispenser according to claim 7, wherein said return member is in the form of a ring or a sleeve of elastomer material surrounding said sectors, at least at a bottom portion thereof.

9. A dispenser according to claim 7, wherein said return member is in the form of bridges of material extending between said sectors.

10. A dispenser according to claim 9, wherein said bridges of material are integrally formed out of the same material as said sectors.

11. A dispenser according to claim 10, wherein said bridges of material are S-shaped.

12. A dispenser according to claim 1, wherein said cylindrical body includes at least one abutment for limiting a stroke of the piston when pushed into the receptacle.

13. A dispenser according to claim 1, wherein at least a part of said drive member is integrally molded with said screw.

14. A dispenser according to claim 1, wherein the screw is integrally molded with a skirt shaped to snap-fasten in a bushing of the receptacle and capable of rotating freely therein.

15. A dispenser according to claim 1, wherein said drive member includes an outer skirt having a cross-section that is elongate in shape.

16. A dispenser according to claim 1, wherein said screw has a pitch lying in the range 2 mm to 16 mm.

17. A dispenser according to claim 1, wherein said product is a body deodorant.

18. A method of manufacturing a product dispenser, the dispenser comprising a receptacle having a cylindrical body including an open end, a piston movable in translation in said body, and a screw passing through an orifice in the piston, the orifice being fitted with link means for transforming rotary motion of the screw into axial displacement of the piston, said screw having a thread and being rotatable by a finger-operated drive member, wherein the method comprises the steps of:

mounting the screw in the receptacle;

introducing the piston to said open end of the cylindrical body; and inserting the piston into the receptacle without rotating the screw, said link means radially deforming while contacting the thread of the screw when the piston moves axially with respect to the screw.

19. A product dispenser comprising:

a receptacle having a cylindrical body including an open end;

a piston axially movable in translation in said body; and a drive screw passing through an orifice in the piston, the orifice being provided with link means for transforming rotary motion of the drive screw into axial displacement of the piston, said drive screw having a thread and being rotatable by a finger-operated drive member, said link means being radially deformable, wherein the link means deforms radially while contacting the thread of the drive screw when the drive screw and the link means are forced to move axially relative to one another thereby allowing the piston to move axially with respect to the screw without rotation of the screw, and wherein, when the piston is resting at a lower portion of the receptacle and the drive screw is rotated in the wrong direction, the link means deforms and allows the screw to rotate to thereby minimize damage to the drive screw and the link means.

* * * * *